US009461415B2

(12) United States Patent
Guo et al.

(10) Patent No.: US 9,461,415 B2
(45) Date of Patent: Oct. 4, 2016

(54) ELECTRICAL CONNECTOR WITH NEW ASSEMBLING METHOD

(71) Applicant: FOXCONN INTERCONNECT TECHNOLOGY LIMITED, Grand Cayman (KY)

(72) Inventors: Bin Guo, Kunshan (CN); Chun-Ming Yu, Kunshan (CN); Guo-Hua Zhang, Kunshan (CN); Qi-Sheng Zheng, Kunshan (CN); Yu-Long Mao, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/834,449

(22) Filed: Aug. 25, 2015

(65) Prior Publication Data

US 2016/0056586 A1 Feb. 25, 2016

(30) Foreign Application Priority Data

Aug. 25, 2014 (CN) ..... 2014 2 0478786 U

(51) Int. Cl.

| | |
|---|---|
| ***H01R 13/648*** | (2006.01) |
| ***H01R 13/6594*** | (2011.01) |
| ***H01R 13/41*** | (2006.01) |
| *H01R 12/72* | (2011.01) |
| *H01R 24/60* | (2011.01) |

(52) U.S. Cl.

CPC ..... *H01R 13/6594* (2013.01); *H01R 13/41* (2013.01); *H01R 12/724* (2013.01); *H01R 24/60* (2013.01)

(58) Field of Classification Search

CPC H01R 13/6594; H01R 13/41; H01R 12/724; H01R 12/57; H01R 24/60

USPC ..... 439/79, 607.05, 607.11, 607.35

See application file for complete search history.

(56) References Cited

U.S. PATENT DOCUMENTS

| | | | | |
|---|---|---|---|---|
| 7,736,184 | B1 * | 6/2010 | Wan | H01R 13/648 439/607.11 |
| 8,251,746 | B2 * | 8/2012 | Zhang | H01R 13/6581 439/607.11 |
| 8,672,711 | B2 * | 3/2014 | Kondo | H01R 12/57 439/607.1 |
| 8,851,927 | B2 * | 10/2014 | Hsu | H01R 13/6594 439/607.11 |
| 8,968,033 | B2 * | 3/2015 | Little | H01R 13/6581 439/607.35 |

FOREIGN PATENT DOCUMENTS

| | | |
|---|---|---|
| TW | M472982-102216154 | 2/2014 |
| TW | M484832-103207409 | 8/2014 |

* cited by examiner

*Primary Examiner* — Khiem Nguyen

(74) *Attorney, Agent, or Firm* — Wei Te Chung; Ming Chieh Chang

(57) ABSTRACT

An electrical connector includes a contact module comprising two rows of contacts retained therein and a shielding plate, the contacts module defining a main base, a middle step and a mating tongue and, the middle step being located between the main base and the mating tongue in a mating direction, the contacts comprising contacting portions exposed on opposite surfaces of the mating tongue; a metallic shell retained on the main base and surrounding the mating tongue and the middle step to define a mating cavity thereamong and a one piece grounding collar. The grounding collar includes a collar portion fitly surrounding the middle step and a grounding plate extending from the collar portion to mechanically and electrically connect with the metallic shell.

16 Claims, 12 Drawing Sheets

ELECTRICAL CONNECTOR WITH NEW ASSEMBLING METHOD

BACKGROUND OF THE INVENTION

1. Field of the Invention

The present invention generally relates to an electrical connector which is mounted on a printed circuit board.

2. Description of the Related Art

USB 3.0 Promoter Group issues a new specification which establishes a new type connector named as USB Type-C Cable and Connector, on Aug. 11, 2014. In the specification, the Type-C plug enhances ease of use by being plug-able in either upside-up or upside-down directions. The receptacle connector has more elements and has smaller, thinner size. Hence, an improved electrical connector is desired, especially to mass product.

BRIEF SUMMARY OF THE INVENTION

Therefore, an object of the present invention is to provide an electrical connector having a position spacer which has guiding means to the terminals.

To fulfill the above-mentioned object, an electrical connector comprises a contact module comprising two rows of contacts retained therein and a shielding plate, the contacts module defining a main base, a middle step and a mating tongue and, the middle step being located between the main base and the mating tongue in a mating direction, the contacts comprising contacting portions exposed on opposite surfaces of the mating tongue; a metallic shell retained on the main base and surrounding the mating tongue and the middle step to define a mating cavity thereamong, and a one piece grounding collar comprising a collar portion fitly surrounding the middle step and a grounding plate extending from the collar portion to mechanically and electrically connect with the metallic shell.

Other objects, advantages and novel features of the invention will become more apparent from the following detailed description when taken in conjunction with the accompanying drawings.

BRIEF DESCRIPTION OF THE DRAWINGS

The foregoing summary, as well as the following detailed description of the embodiments of the present invention, will be better understood when read in conjunction with the appended drawings. For the purpose of illustrating the invention, there are shown in the drawings embodiments which are presently preferred. As should be understood, however, the invention is not limited to the precise arrangements and instrumentalities shown. In the drawings.

DETAILED DESCRIPTION OF THE PREFERRED EMBODIMENT

Reference will now be made in detail to the preferred embodiment of the present invention.

Figure 1:
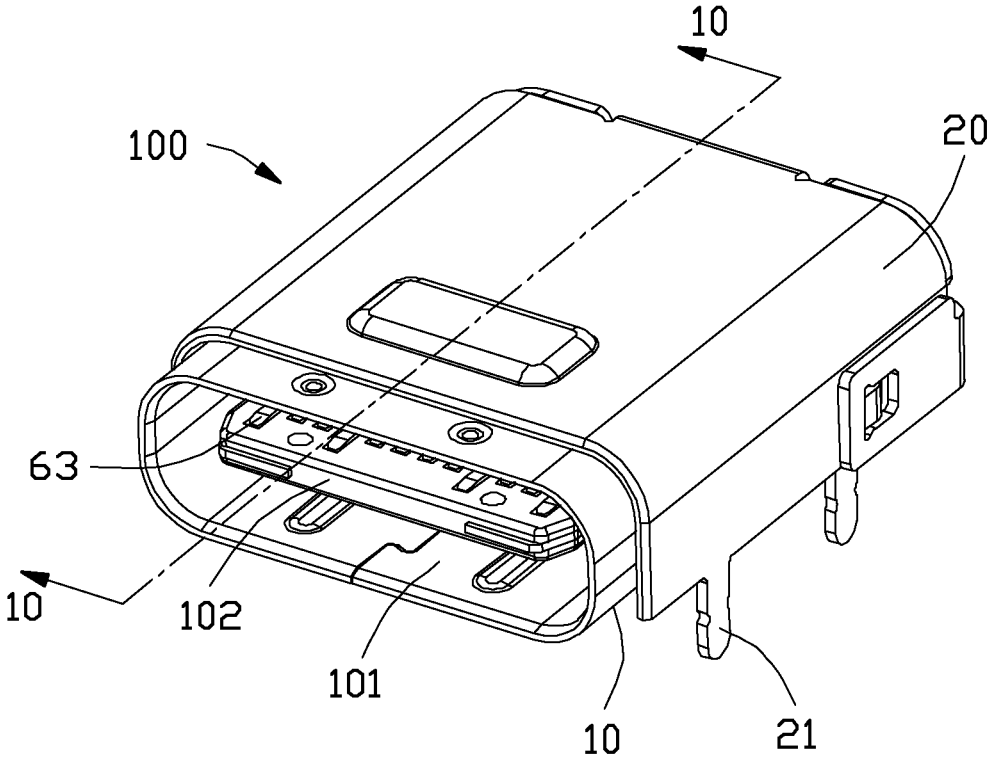
FIG. 1 is a top perspective view of an electrical connector made in accordance with the present invention.
Figure 2:
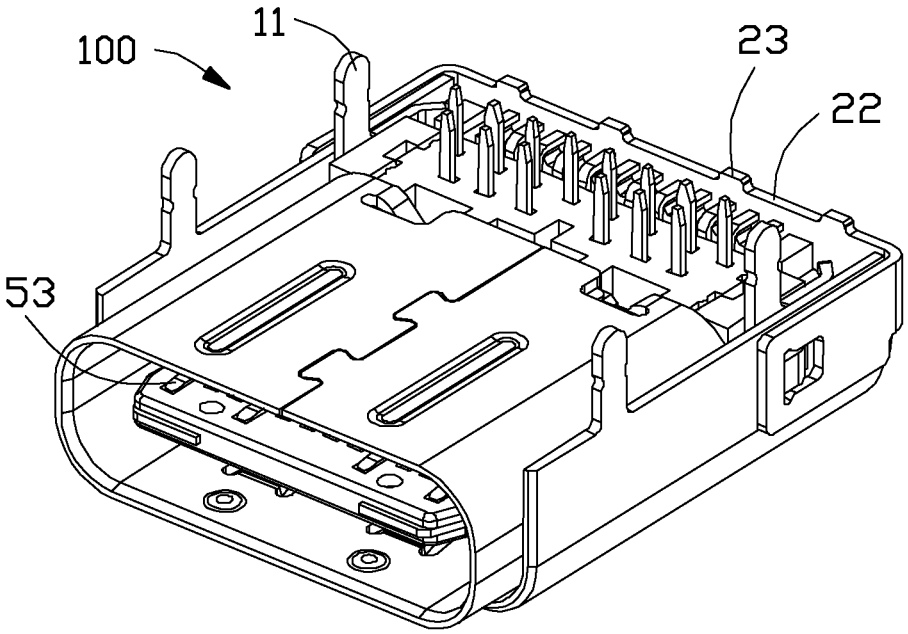
FIG. 2 is a bottom assembled perspective view of the electrical connector.

Please referring to FIGS. 1 and 2, an electrical connector 100 is intended to be mounted on a printed circuit board (PCB, not shown). The electrical connector 100 comprises a metallic shell 10 defining a mating cavity 101, a mating tongue 102 extending into the mating cavity 101 and two rows of terminals (upper terminals 63 and lower terminals 53) arranged on the opposite surfaces of the mating tongue 103. In front view, the mating cavity 101 has a capsular configuration outlet which can be inserted into a corresponding plug connector, in either of two insertion orientations. A metallic bracket 20 is surrounded with shell 20, which defines two pairs of leg 21 to be mounted on the PCB. The shell 10 defines a pair of leg 11 behind the legs 21 of the metallic bracket 20. The bracket 20 covers corresponding top wall, two side walls and a rear wall of the electrical connector 100. The rear wall 22 of the bracket 20 defines a plurality of soldering points 23 projecting towards the PCB.

Figure 3:
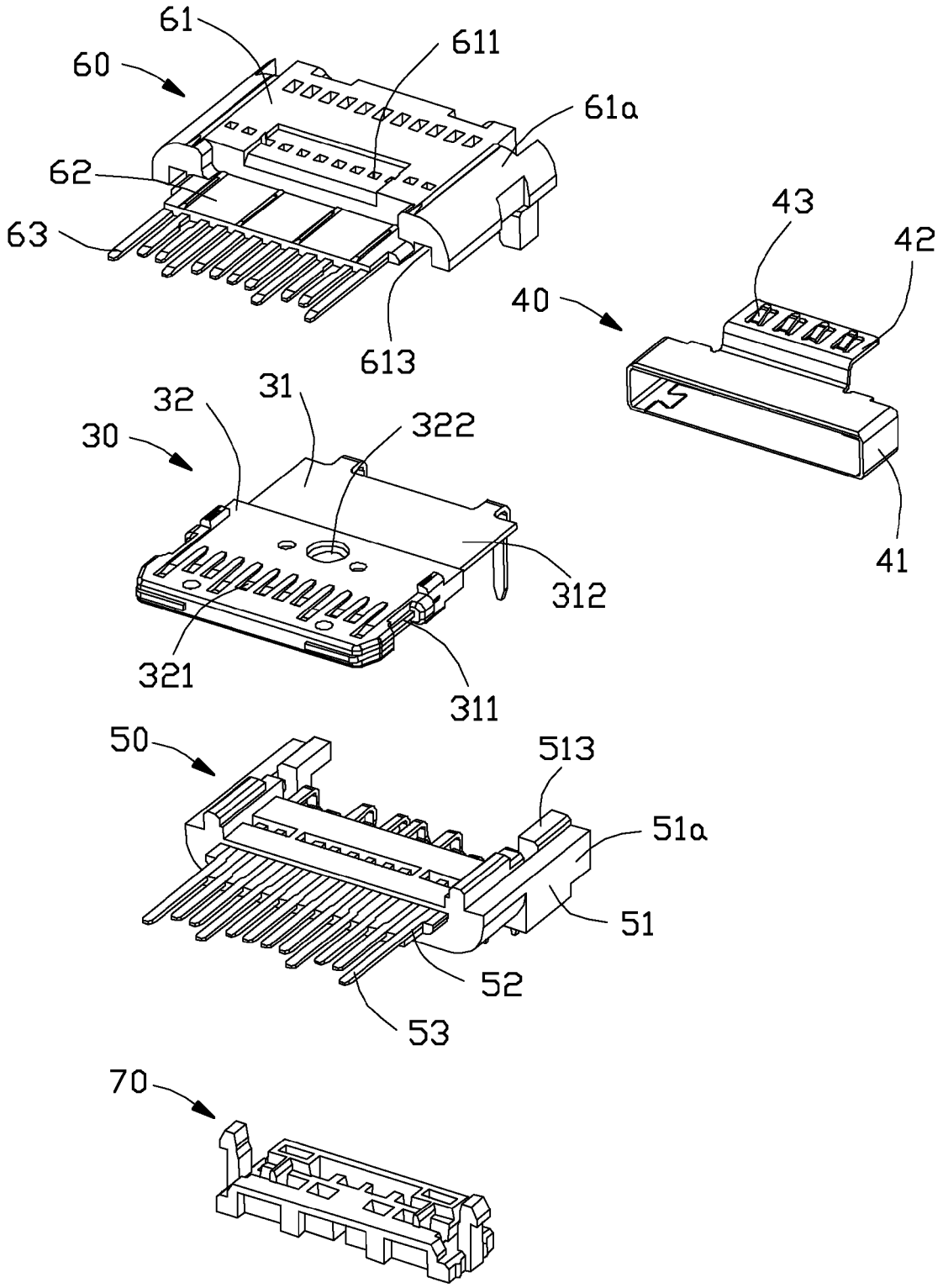
FIG. 3 is a top exploded perspective view of terminal module of the electrical connector shown in FIG. 1.
Figure 4:
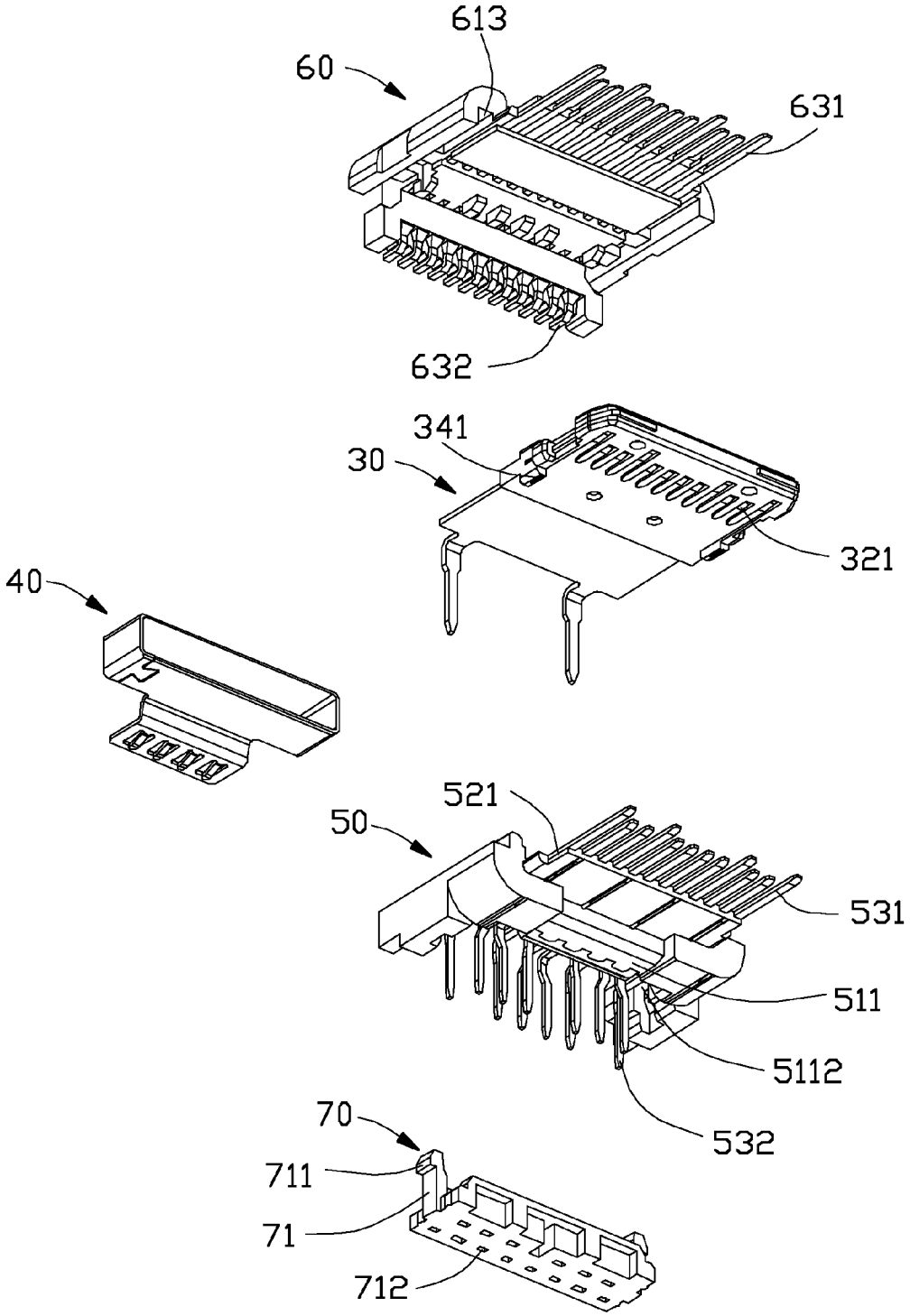
FIG. 4 is a bottom exploded perspective view of terminal module of the electrical connector shown in FIG. 2.

Please referring to FIG. 3 and FIG. 4, the electrical connector 100 includes a tongue member 30, a grounding collar 40, an upper module 60 retained with the upper terminals 63 and a lower module retained with the lower terminals 53, which is constructed as a terminal module. The tongue member 30 is retained with a shielding plate 31.

Referring to FIG. 3 through FIG. 9, the tongue member 31 includes the shielding plate 31 and a middle insulator 32 inserted molded with the shielding plate 31. A front region 311 of the shielding plate is embedded in the insulator 32 and a rear region 312 exposes to the middle insulator 32. The front side edges of the front region 311 of the shielding plate 31 project beyond corresponding edges of the middle insulator 32. The middle insulator 32 defines a notch to exposes the shielding plate 31, so that the shielding plate 31 has two opposite locking sides (not labeled), which are locked with a metallic latch of the plug. In brief, the shielding plate 31 is essentially multifunctional to perform shielding, grounding, reinforcing, anti-mis-mating and locking. The middle insulator 32 defines, via a plurality of protruding partitions (not labeled), two rows of grooves 321 on opposite surfaces thereof to receive the terminals 63, 53, the shielding plate 31 is located between the two rows of the terminals. The middle insulator 32 further defines a plurality of circle holes 322 with different dimensions behind the grooves 321. These holes 322 are retained when mold cores is withdraw from the middle insulator 32 after an inserted mold process.

Figure 5:
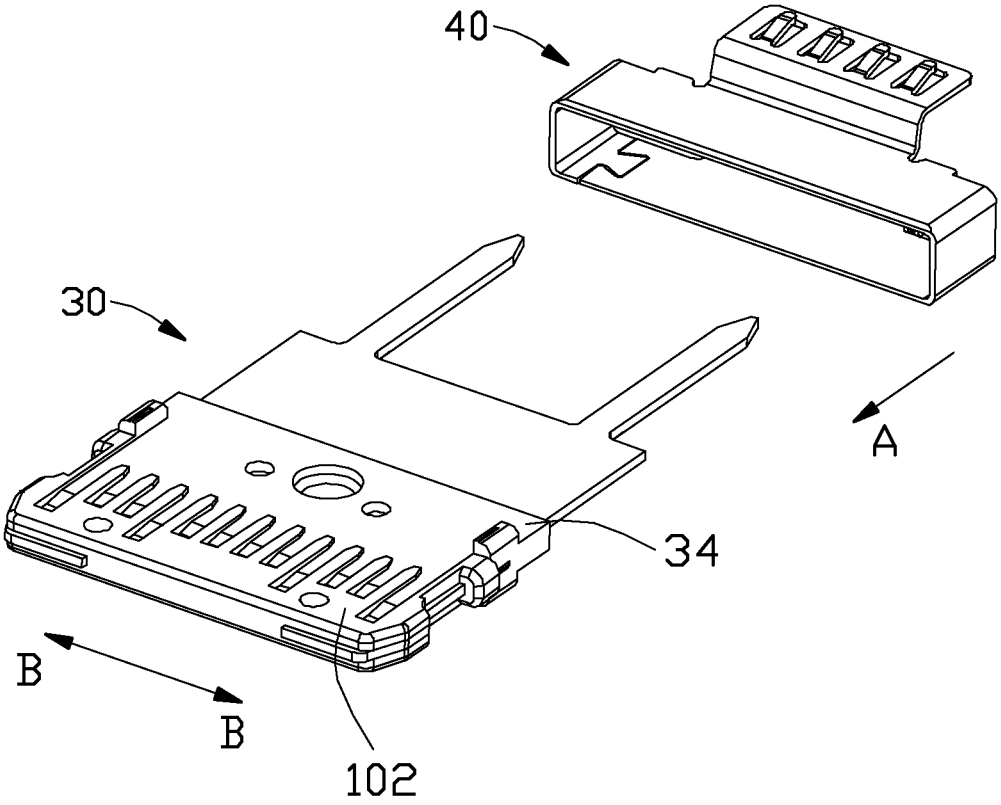
FIG. 5 is an exploded perspective view showing an assembling process of the grounding collar to the tongue member.
Figure 6:
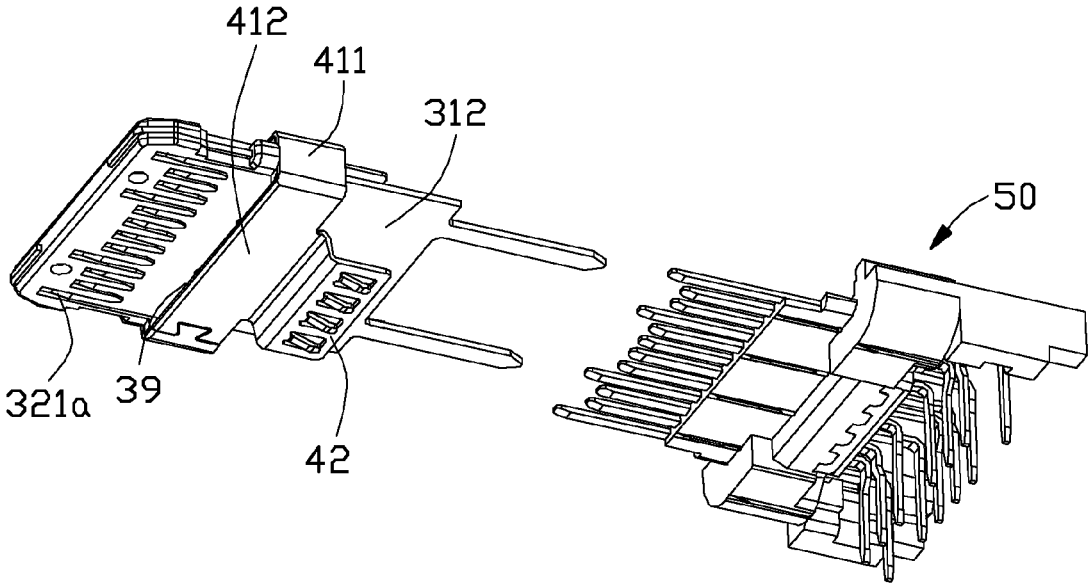
FIG. 6 is an exploded perspective view showing an assembling process of the lower module to the assembled tongue member and the grounding collar.
Figure 7:
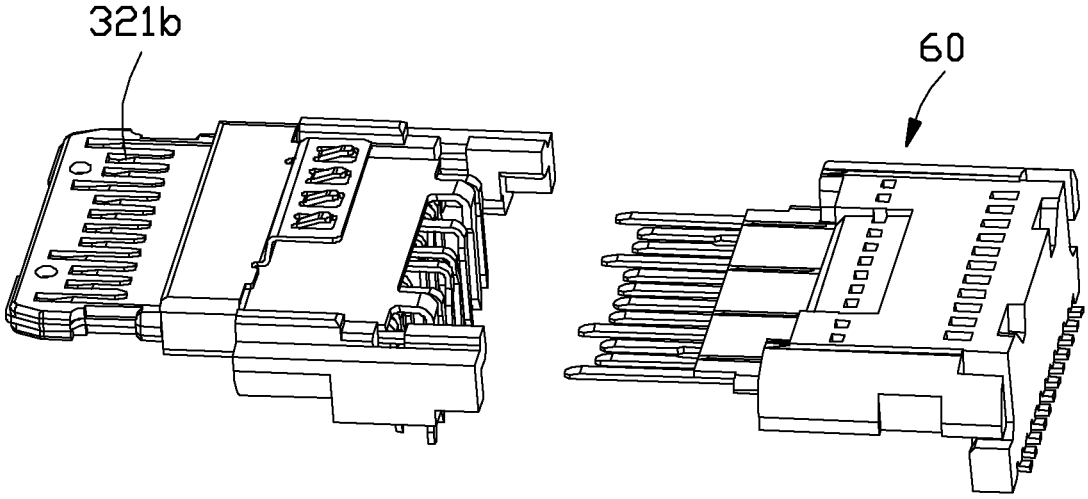
FIG. 7 is an exploded perspective view showing an assembling process of the upper module to the assembled tongue member, the grounding collar and the lower module.

The grounding collar 40 include a collar portion 41 and two grounding plates 42 extending from two rear edges of the collar portion 41. Each grounding plate 42 is punched with a plurality of spring tabs 43 which are arranged along a lateral direction and each extends in a front to rear direction. Referring to FIGS. 5-6, the grounding collar 40 is assembled to the tongue member 30 in a rear to front direction and retained on middle insulator 32 near to a rear portion of the middle insulator. After assembled, there are two spaces 39 between opposite surfaces of the tongue member 30 and the collar portions 41. The tongue member 30 defines a front tongue 33 and a rear portion, the front tongue 33 is larger than the rear portion in lateral dimension in a direction labeled as B-B. The grounding collar 40 is retained on the rear portion. The two short walls 411 of the collar portion 41 are retained on the lateral sides of the rear portion and stop against a stop rear face of the front tongue 33. The spaces 39 are defined between the long wall 412 and the tongue member 30. The grounding plates 42 are located at two sides of the rear region of the shielding plate 31.

The lower module 50 comprises a lower insulator 51*a* and lower terminals 53 retained in the lower insulator 51*a* via an insert molding process, the lower insulator 51*a* includes a rear base 51 and a front step 52, the lower terminals comprises contacting portion 531 extending from the front step 52 and legs 532 extending from the rear base 51. The legs 532 of through-hole type are arranged in two rows in the front and rear direction. Please referring to FIGS. 6 and 7, the lower module 50 is assembled forwards into the lower space 39 below the tongue member 30 and retained below the lower surface of the tongue member 30. The contacting portions 531 are received in the grooves 321*a*. A spacer 70 is assembled to the legs 532 in a lower to upper direction. The spacer 71 defines a plurality of positioning holes 712 to receive legs 532 of the row of lower terminals and a pair of retaining arms 71 integrally extending therefrom, each retaining arm 71 defines a projecting-outwards hook 711 which engage with corresponding slot 5112 defined on a bottom face of the rear base.

The arrangement of the upper module 60 are similar to that of the lower module 50 only with some minor differences. The upper module 60 includes an upper insulator 61*a* and upper terminals 63, the upper insulator 61*a* includes a rear base 61 and a front step 62, the upper terminals 63 includes contacting portions 631 extending from the front step and legs 632 extending from the rear base 61. The legs 632 bend downwards to form one row of the SMT type legs. Please referring to FIGS. 7 and 8, the upper module 60 is assembled in the upper space 39 above the tongue member 30 and retained on the tongue member. The upper contacting portions 632 are received in the grooves 321*b*.

Referring to FIGS. 3 and 4, a stopper 341 is defined at a joint of the front tongue 33 and the rear portion, which project beyond the rear portion in the vertical direction, the front step 52 defines notch 521 at opposite lateral side thereof to engage with the stopper 341 when the lower module is inserted. Therefore the lower module 50 is prevented from moving forwards. So as to the upper module 60. The confronting faces of the lower module and upper module define retaining ribs 513 and slots 613 engaging with each other. When the upper module is inserted in the space 39, the slot 613 defined on the upper module is guided and limited to move along the retaining rib 513 in the front and rear direction.

Figure 8:
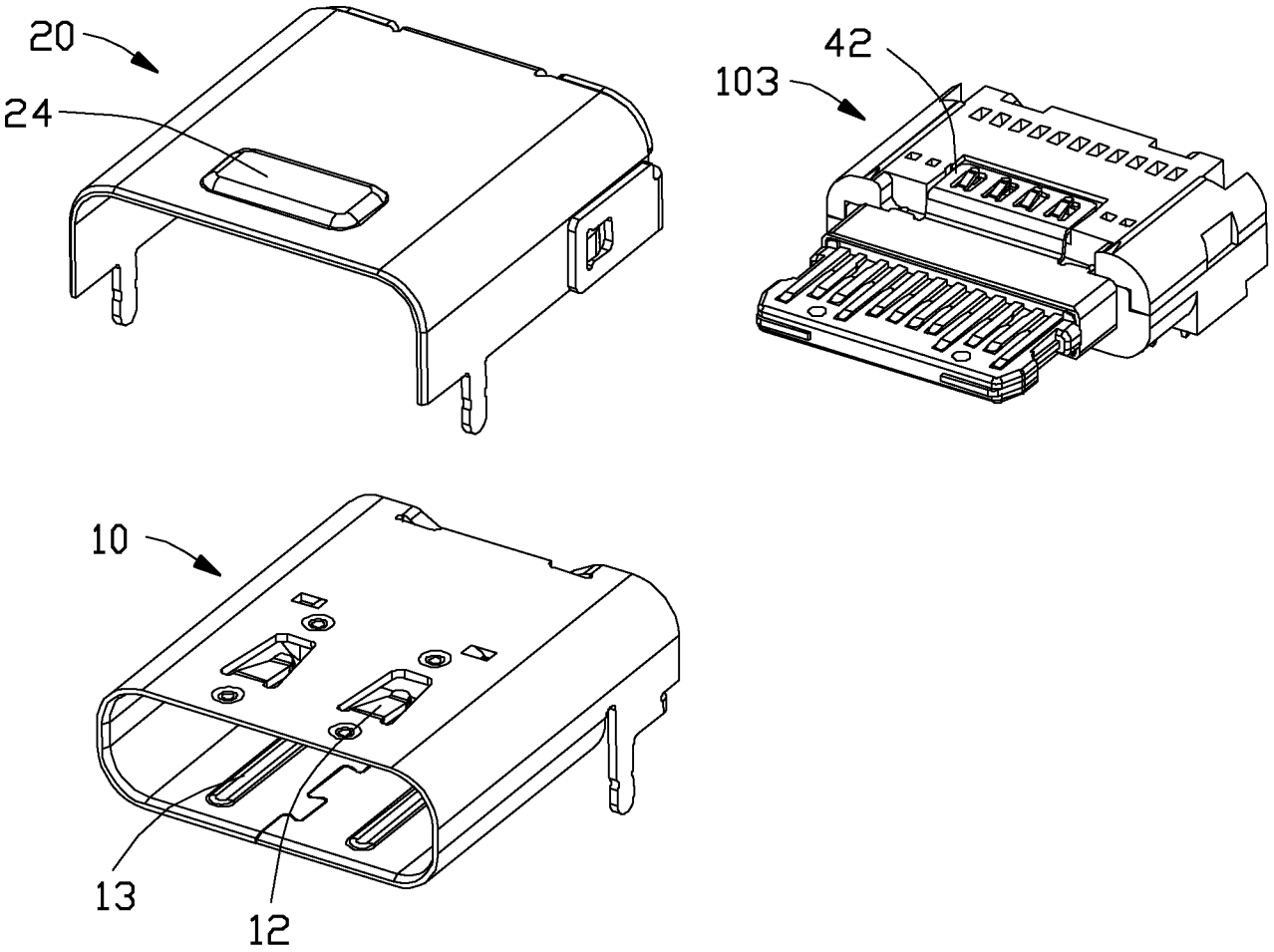
FIG. 8 is an exploded perspective view of the electrical connector of FIG. 1.
Figure 9:
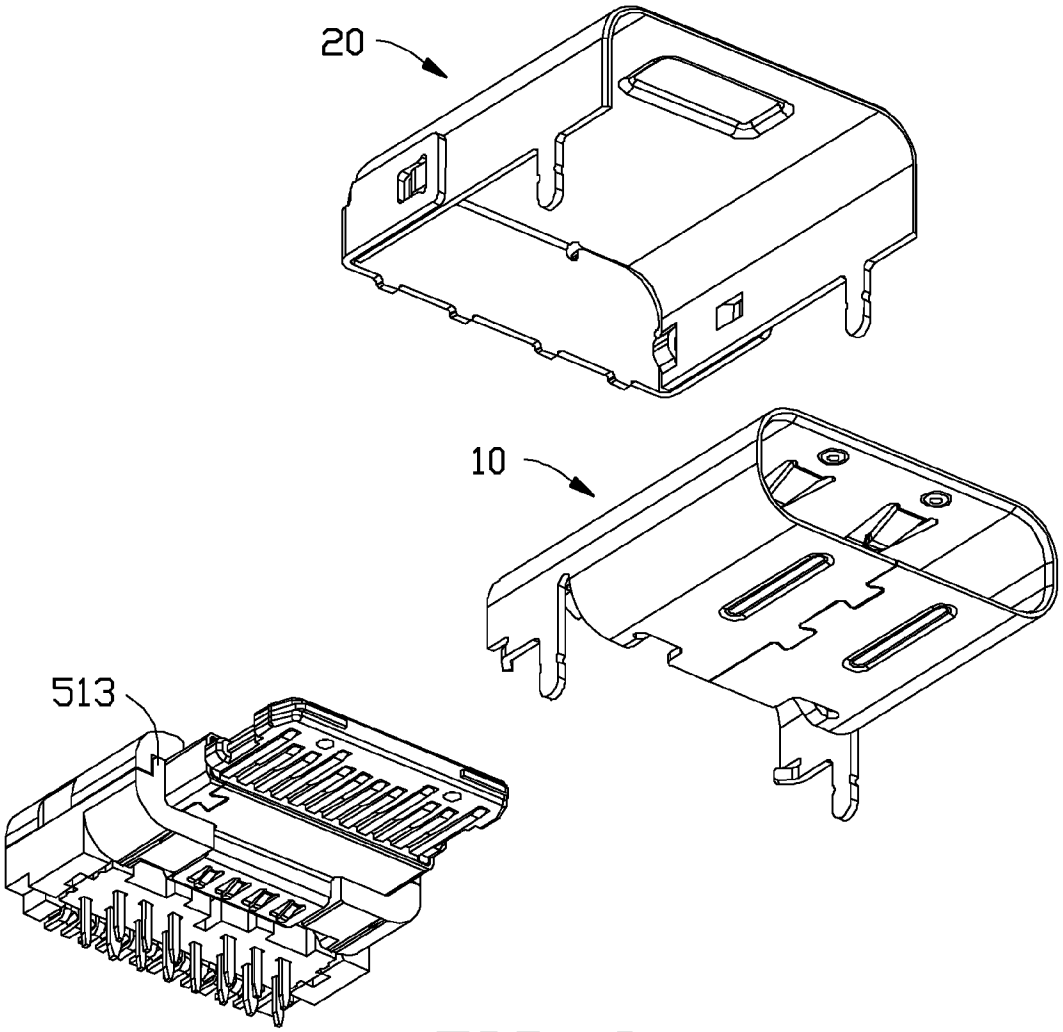
FIG. 9 is an exploded perspective view of the electrical connector of FIG. 2.
Figure 10:
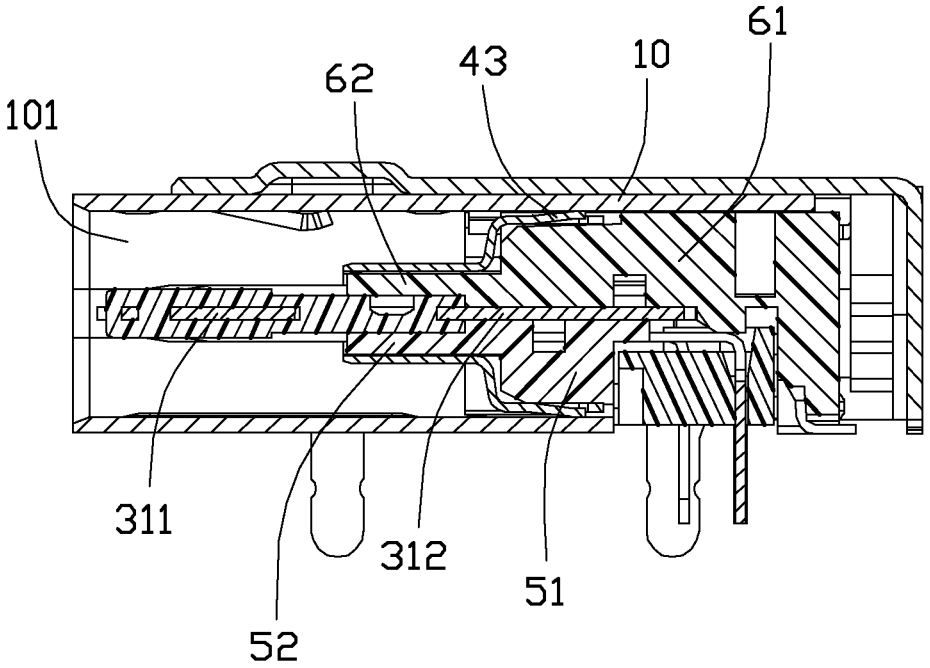
FIG. 10 is a cross-sectional view of the electrical connector taken along line 1-1 of FIG. 1.
Figure 11:
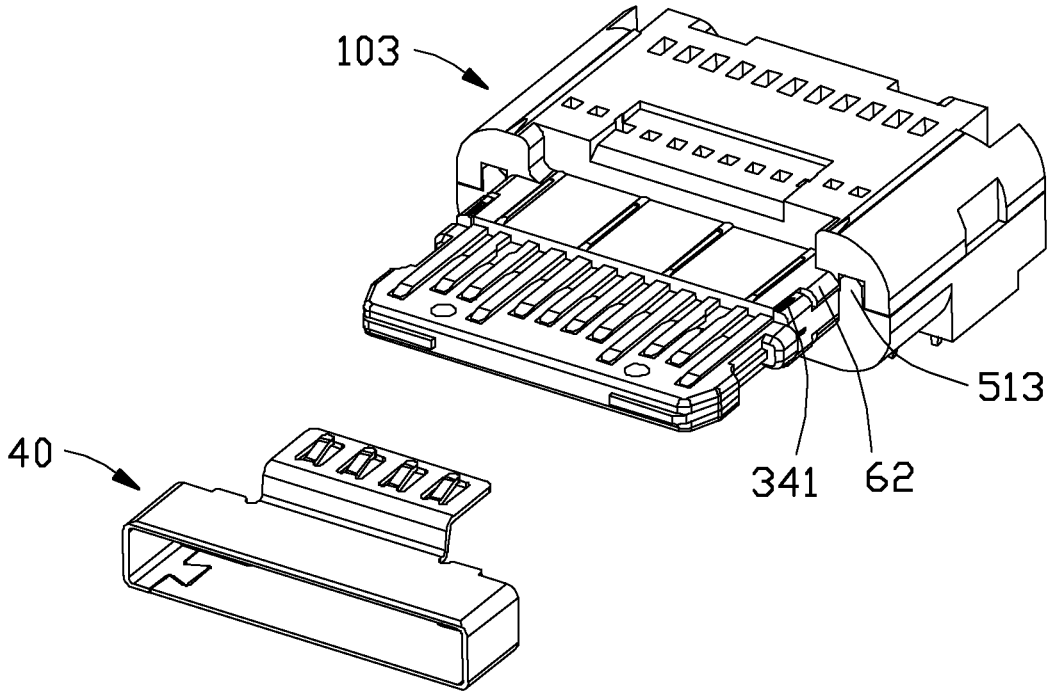
FIG. 11 is a partly perspective exploded view of the terminal module showing an engagement of the upper and lower module.
Figure 12:
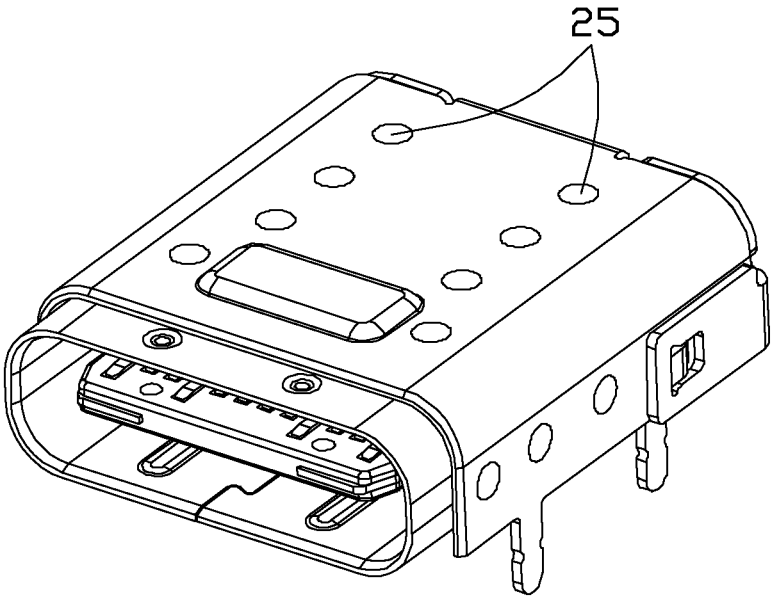
FIG. 12 is an assembled perspective view of the electrical connector showing the bracket is laser welded.

Anyway, the grounding collar 40 firstly moves forwards to surround and be retained on the tongue member 30 wherein two opposite spaces 39 are formed at opposite side of the tongue member 30. The upper and lower modules 60, 50 move forward and insert into the two spaces 39 wherein the contacting portions of the upper and lower terminals are received in the grooves and the upper and lower steps 62, 52 are retained in the grounding collar 40. Therefore, a terminal module 103 is constructed as best shown in FIGS. 8 and 9. The terminal module comprises two rows of terminals 63, 53 and the shielding plate 31 retained therein, the contacts module defines a main base (including the rear bases 61, 51), a middle step (including the front steps 62, 52) and the mating tongue 102 (i.e., the front tongue 33), the middle step is located between the main base and the mating tongue in a mating direction. The contacting portions are exposed on opposite surfaces of the mating tongue 102 and legs extending from the main base. The shielding plate 31 defines two opposite locking sides. The terminal module 103 includes a main base, the mating tongue and a middle step between the main base and the mating tongue, the contacting portions of the upper and lower contacts are exposed on opposite surfaces of the mating tongue. The positioning holes 712 of the spacer 71 receives legs 532 of the row of lower terminals and the pair of retaining arms 71 defines a pair of projecting-outwards hook 711 which engage with corresponding slot 5112 defined on main base. The metallic shell 10 is fitly retained on the base portion and surrounding the mating tongue and middle step to define the mating cavity 103 therebetween. The collar portion 40 is fitly surrounding the middle step and the grounding plates 42 mechanically and electrically contact the metallic shell via the spring tabs 43. The grounding plate 42 is disposed in shallow recesses 611 as best shown in FIGS. 3 and 4 defined on the rear base of the upper and lower modules. As shown in FIG. 10, the rear region 312 of the shielding plate is exposed to the tongue member and sandwich between the rear bases of the upper and lower module.

Referring to FIGS. 8 through 10, the metallic shell 10 defines spring arms 12 slantwise extending into the mating cavity 103 on a top wall thereof and two longwise ribs 13 extending in the front and rear direction on the bottom wall thereof. The metallic bracket 20 is soldered on the shell 10 by laser weld as labeled numeral 25. The bracket 10 defines a cap portion 24 punched from a top wall thereof without any slot between the bracket 10 and the cap portion 24, so that the spring arms 12 can be shift in the vertical direction. One feature of the invention is to have the front portion of the contacting section of the terminal on the tongue member is received within the corresponding groove without lateral exposure while the rear portion of the contacting section of the terminal on the tongue member is laterally exposed to the neighboring terminal for the impedance control consideration.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a contact module comprising two rows of contacts retained therein and a shielding plate, the contacts module defining a main base, a middle step and a mating tongue and, the middle step being located between the main base and the mating tongue in a mating direction, the contacts comprising contacting portions exposed on opposite surfaces of the mating tongue;

a metallic shell retained on the main base and surrounding the mating tongue and the middle step to define a mating cavity there among;

a one piece grounding collar;

wherein the grounding collar comprises a collar portion fitly surrounding the middle step and a grounding plate extending from the collar portion to mechanically and electrically connect with the metallic shell.

2. The electrical connector as claimed in claim 1, wherein the grounding plate defines at least three tabs punched therefrom to elastically contact the metallic shell.

3. The electrical connector as claimed in claim 1, wherein the contact module comprises an upper module retained with a row of upper contacts of said two rows of contacts, a lower module retained with a row of lower contacts of said two rows of contacts and a tongue member retained with the shielding plate.

4. The electrical connector as claimed in claim 3, wherein the tongue member comprises a middle insulator and the shielding plate is embedded in the middle insulator, the middle insulator comprises a front region and a rear region smaller than the front region so that the front region defines a stopping rear face against which the collar portion press.

5. An electrical connector comprising:

a contact module comprising two rows of contacts and a shielding plate retained therein, the contacts module defining a main base, a middle step and a mating tongue and, the middle step being located between the main base and the mating tongue in a mating direction, the contacts comprising contacting portions exposed on opposite surfaces of the mating tongue and legs extending from the main base, the shielding plate defines two opposite locking sides;

a metallic shell retained on the main base and surrounding the mating tongue and the middle step to define a mating cavity thereamong; and a spacer;

wherein the spacer defines a plurality of positioning holes to receive legs of the row of lower contacts and a pair of retaining arms integrally extending therefrom, each retaining arm defines a projecting-outwards hook which engages with corresponding slot defined on a bottom face of the main base.

6. The electrical connector as claimed in claim 5, comprising a one piece grounding collar, wherein the grounding collar comprises a collar portion fitly surrounding the middle step and a grounding plate extending from the collar portion to mechanically and electrically connect with the metallic shell.

7. An electrical connector comprising a contact module including an upper module and a lower module commonly sandwiching a tongue member therebetween in a vertical direction, the tongue member including a middle insulator with a metallic shielding plate embedded therein, said shielding plate rearwardly extending beyond a rear end of the middle insulator, a plurality of upper protruding partitions to form corresponding upper grooves in a front region of an upper surface of the middle insulator while said upper protruding partitions are terminated in a rear region of the upper surface of the middle insulator, a plurality of lower protruding partitions to form corresponding lower grooves in a front region of a lower surface of the middle insulator while said lower protruding partitions are terminated in a rear region of the lower surface of the middle insulator, the upper module including an upper insulator with a plurality of upper terminals embedded therein, each of said upper terminals defining an upper contacting section, of which a front portion is disposed in the corresponding upper groove;

a lower module including a lower insulator with a plurality of lower terminals embedded therein, each of said lower terminals defining a lower contacting section, of which a front portion is disposed in the corresponding lower groove; wherein rear portions of the upper contacting sections of said upper terminals are exposed laterally to neighboring upper terminals for impedance control, and rear portions of the lower contacting sections of said lower terminals are exposed to the neighboring terminals for impedance control.

8. The electrical connector as claimed in claim 7, wherein the upper module, the lower module and the tongue member commonly form a middle step on which a one piece metallic grounding collar fully surrounds.

9. The electrical connector as claimed in claim 8, wherein said grounding collar includes a collar portion surrounding said middle step, and a pair of plates extending rearwardly from opposite upper rear edges and lower rear edges, respectively.

10. The electrical connector as claimed in claim 9, further including a metallic shell enclosing said terminal module wherein said pair of plates mechanically and electrically connecting to said shell in a vertical direction.

11. The electrical connector as claimed in claim 8, wherein the tongue member forms a pair of shoulders in front of the middle step to allow said grounding collar to be assemble to the tongue member only forwardly from a rear side of the tongue member along a front-to-back direction.

12. The electrical connector as claimed in claim 11, wherein said shielding plate includes a pair of legs extending beyond the rear end of the middle insulator, and said grounding collar is assembled to the tongue member before said pair of legs are bent downwardly.

13. The electrical connector as claimed in claim 12, wherein the said shielding plate includes a pair of legs extending beyond the rear end of the middle insulator, and said lower module is assembled to the tongue member after the grounding collar is assembled to the tongue member while before said pair of legs are bent downwardly.

14. The electrical connector as claimed in claim 13, wherein said upper module is assembled to the tongue member after the pair of legs are bent downwardly.

15. The electrical connector as claimed in claim 14, wherein said shielding plate forms a pair of locking notches in two opposite lateral sides.

16. The electrical connector as claimed in claim 14, wherein said upper insulator and said lower insulator have means for being engaged with each other to restrain relative movement therebewteen in a lateral direction.

* * * * *